US006761931B1

(12) United States Patent
Cochran et al.

(10) Patent No.: US 6,761,931 B1
(45) Date of Patent: Jul. 13, 2004

(54) METHOD FOR PISTON COATING

(75) Inventors: Theodore R. Cochran, Amherst, NY (US); Mingguang Zhu, E. Amherst, NY (US); Rebecca E. Bish, Buffalo, NY (US); Douglas Bahun, New Carlisle, OH (US); Michael J. Schwab, Hamilton, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/346,904

(22) Filed: Jan. 17, 2003

(51) Int. Cl.[7] ..... B05D 1/28; B05D 3/02
(52) U.S. Cl. ..... 427/314; 427/372.2; 427/428
(58) Field of Search ..... 427/428, 314, 427/318, 372.2; 118/620, 641, 642, 60, 202, 244, 262; 29/888.074, 888.048

(56) References Cited

U.S. PATENT DOCUMENTS 5,941,160 A 8/1999 Kato et al. ..... 92/155
6,086,699 A * 7/2000 Nakashima et al. ..... 156/230
6,283,012 B1 9/2001 Kato et al. ..... 92/155

* cited by examiner

*Primary Examiner*—Katherine A. Bareford
(74) *Attorney, Agent, or Firm*—Patrick M. Griffin

(57) ABSTRACT

A piston or similar cylindrical work piece is wear coated with a liquid coating material comprised of a solid component carried by a volatile solvent. The coating material is applied, from a closed reservoir, by a synchronously rotated distribution roller, to a larger diameter coating roller that is continually heated to a temperature sufficient to remove a majority of the solvent. Simultaneously, the piston workpiece is pre heated to a comparable temperature before being engaged with the coating roller under a relatively high pressure. A series of thin, pre dried layers is applied to the workpiece surface sufficient to produce the a final wear layer of a desired final thickness.

5 Claims, 4 Drawing Sheets

METHOD FOR PISTON COATING

TECHNICAL FIELD

This invention relates to compressor pistons in general, and specifically to a method for coating a piston with a wear protection layer.

BACKGROUND OF THE INVENTION

Air conditioning system compressors have, for some time, been made from aluminum alloy, as have the cylinder blocks within which the pistons reciprocate. The pistons are subject to significant side load, and it has been conventional practice to apply a wear protective coating, typically a mixture of a resin binder such as polyamideimide, a dry lubricant (such as PTFE) if desired, a suitable solvent and a neutral filler to round out the mixture to the piston. One conventional coating application method is a simple spray application, followed by a heat curing step and a final machining of the cured layer to bring the piston to size. Spray coating inevitably coats parts of the piston that don't need it, barring an additional, labor intensive masking step. Also, in order to achieve a sufficiently thick coating layer in one spray coat, a thick coating must be applied, which is subject to sagging and running.

A well known alternative to spray coating the entire piston is to either screen print or roller coat only a defined area of the piston. In screen printing, a piston is rolled beneath and against a flat screen that has been provided with a "rolled out" pattern corresponding to the coating pattern that is desired on the cylindrical piston. A supply of coating material on the top of the screen is forced by a squeegee through the screen and onto the surface of the piston, in a single 360 degree (at most) turn and in a single layer. In roller coating, coating material from an open pan is transferred by a metal roller to a hard rubber roller and printed from the hard rubber roller onto the piston workpiece, also in a single workpiece rotation and single layer. The wet coated pistons are transferred to an oven for later heat curing, which removes the solvents and leaves the solid, hardened coating behind. In most cases, the pistons must be ground to final size after curing, since the coating itself cannot be applied with sufficient precision in terms of its thickness. Therefore, extra coating thickness has to be applied in the first place. Examples may be seen in U.S. Pat. Nos. 5,941,160 and 6,283,012, each of which discloses the same basic roller coating apparatus, although the latter claims that the final grinding step is not needed. Shortcomings in these known techniques result both from the apparatus and methods themselves, as well as the coating materials.

The main drawback of known roller coating methods and apparatuses is the fact that, in order to achieve a sufficiently thick coat in a single layer that does not run or drip on the workpiece surface, the coating must be relatively thick and viscous. For example, the viscosity of the coating material in U.S. Pat. No. 6,283,012 is said to be between 5000 and 150,000 centipoise. Such a thick, one layer coating, regardless of viscosity, is still liable to running or dripping, necessitating that the piston continually be rotated to prevent differential gravitational effects on the thick, poorly adhered layer. The thick layer is also prone to bubbling in the curing oven, as the solvent is flashed out. Grit or sand blasting of the surface has generally been necessary as a pre treatment to the piston surface to get the coating layer to stick to the surface, also. Futhermore, there is a limit on how thick such a single layer coating can practically be applied, regardless of its high viscosity. Experience has shown that such a single layer can really only be reliably applied to a thickness of about 15 microns, despite claims to the contrary, and it is best if the coating layer, post grinding, is at least 35 microns thick. Even if such single layer coating methods work as well as possible, there is an inevitable area of overlap at the beginning and end of the layer that is thicker than desired, and even more subject to sagging. Another practical shortcoming is that the open pan of coating material used in conventional roller coating is continually both losing organic solvent to the surrounding air, and forming a skin on the top, which must be continually removed, and which causes variations in viscosity of the raw material.

As noted above, known coating materials and mixtures themselves have shortcomings. For example, the main coating constituent disclosed in one of the aforementioned patents is PTFE, which has a very high ratio relative to the polyamide resin binder, ranging from 0.8 to 3. Both patents stress the claimed importance of high levels of PTFE. However, PTFE is relatively soft with a low mechanical strength, and has a significantly higher coefficient of thermal expansion, as compared to the aluminum surface to which it must bind. A weak coating layer that is differentially thermally stressed at the part-layer interface is clearly not optimal or ideal. Furthermore, while PTFE may present some advantages in terms of dry lubricity when a compressor starts up, once in is running with a layer of refrigerant and entrained oil located in the piston-cylinder surface interface, high levels of PTFE can in fact jeopardize the ability of the oil to wet the surface.

SUMMARY OF THE INVENTION

The subject invention provides a method and apparatus for practicing the method that coats a piston or other cylindrical workpiece not in a single, thick layer, but which rolls on multiple, very thin layers in rapid succession, creating a final, thicker layer that adheres without surface pre treatment, and which is solid, even and strong.

Instead of applying a very viscous coating material directly out of an open pan, a less viscous coating material is maintained at the proper viscosity and homogeneity within a closed tank, preventing solvent loss and skinning. Coating material is pumped from the tank through a line and distributed by a nozzle to an engraved metal roller that distributes a controlled amount of coating material onto a larger diameter elastomer coating roller, in a pattern and to a depth determined by the etched pattern on the metal distribution roller. Beneath the coating roller, a heated manifold continually heats the coating roller to a temperature well below the coating curing temperature, but sufficiently high to flash off much of the solvent. Concurrently, a piston workpiece that has been pre heated (but not grit blasted or otherwise pre treated) to a similar temperature is brought into pressurized contact with the coating roller. The coating material deposited on the pre heated piston surface has much of the remaining solvent flashed away, and a thin, solid layer is deposited on the piston surface with each turn. The pressurized contact maintains the thinness of the layer, and also assures good surface adhesion. The piston is coated for as many turns and with as many thin, tightly adhering layers as desired, which build up effectively into a single thicker, homogenous and even layer, with most of the solvent already gone. Each thin layer is deposited quickly, and the piston need not be rolled or otherwise manipulate to prevent sagging before it is sent to the curing oven. The curing oven hardens the final layer, as normally, even though most of the solvent is pre removed, and the part is final ground to size.

The coating material uses a conventional polyamide resin binder and organic solvent, but with a very low, almost negligible percentage of PTFE, so low that the final coating layer would not be considered a solid lubricant coating as such. Instead of soft, low strength PTFE, a higher strength ceramic material, titanium dioxide, is mixed with the resin binder as a primary component. This provides a much harder, stronger final coating layer, which has better compatibility with oil, and better performance at high temperature and loading. In addition, the titanium dioxide component has a smaller differential of thermal expansion relative to aluminum, so as to better maintain surface adhesion at high temperatures.

DESCRIPTION OF THE PREFERRED EMBODIMENT

Figure 1:
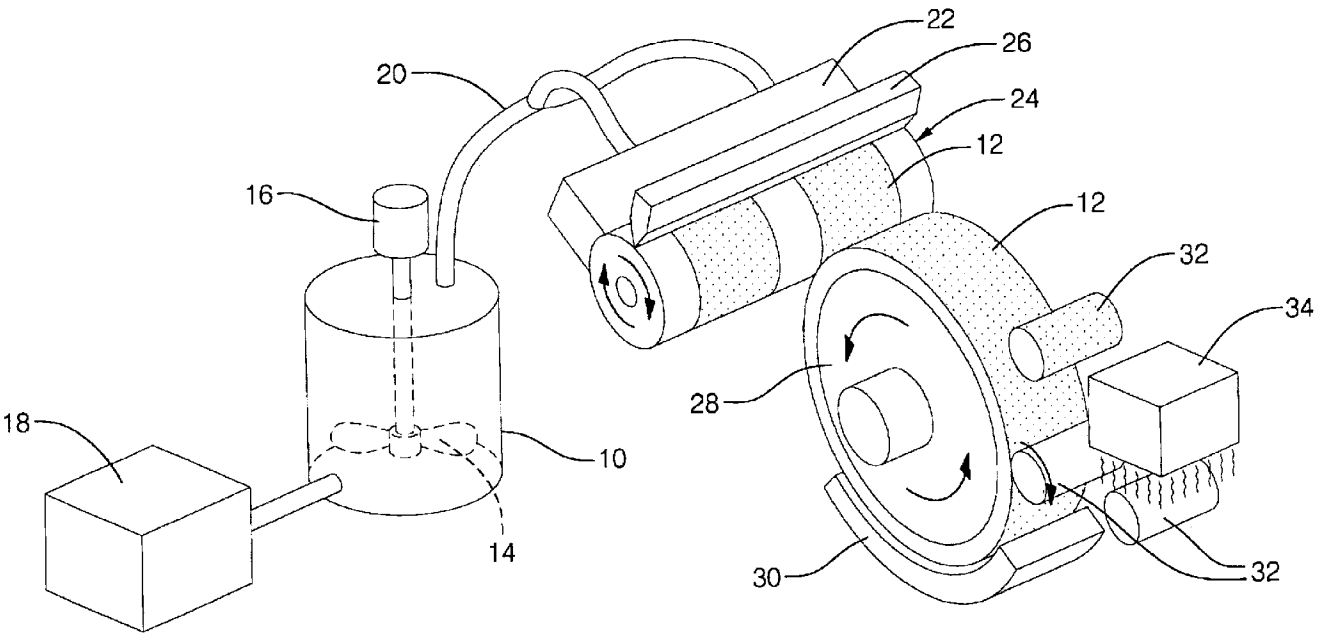
FIG. 1 is a schematic perspective view of and apparatus for carrying out the method of the invention.

Referring first to FIG. 1, which is a generalized schematic views of the various elements of the apparatus, a closed tank 10 contains a supply of coating material 12, sealed from the surrounding environment and continually mixed by a mixing tool 14 and monitored by a viscometer 16. Details of the coating material will be given below, but, in general, the solid portion of the mixture comprises a very low percentage by weight of PTFE, a significant percentage, and a relatively high percentage of titanium dioxide, with the balance being a conventional polyamideimide resin binder. In general, this represents a far smaller, almost negligible, percentage of PTFE than conventional piston coatings. In addition, the solvent-solid proportion of the mixture in tank 10 is such as to create a far lower viscosity, approximately 2100 cps within a 400 cps tolerance range, than is typical. A reserve supply of solvent 18 (chemical details given below) is fed into tank 10 as needed to maintain the viscosity within an acceptable range. Because the tank 10 is closed, unlike the conventional open pan, solvent is not lost continually to the air, nor does a hardened skin form on the surface, making it easier to maintain the range of viscosity and homogeneity.

Still referring to FIG. 1, coating material 12 is pumped under low pressure from closed tank 10 through closed line 20 to a nozzle assembly 22, where it is applied to a metal distribution roller or "cliché" indicated generally at 24, and spread onto its surface in a thickness controlled layer with the assistance of a blade or squeegee 26. The cliché 24 engages a larger diameter, resilient elastomer coating roller 28 and rotates with it in synchronized fashion to transfer coating material 12 to roller 28 in a similarly thickness controlled layer. Cliché 24 is two sided, as is roller 28, but only one side of roller 28 is shown. Unlike a conventional process, however, the coating material 12 that is transferred to coating roller 28 is also continually heated by a heating manifold 30 that wraps closely around its bottom portion of roller 28. The concurrent heating flashes out much of the solvent, but leaves the coating material 12 sufficiently wet to still be transferable. Also concurrently, a piston workpiece 32 (approximately 32 mm in diameter) is pre heated to a similar temperature by a radiant heater 34 before it is applied against the coating roller 28, under a significant pressure. Piston 32 is shown in several moved positions. Coating roller 28 transfers coating material 12 onto piston 32, and the pre heated piston surface flashes out even more volatile organic solvent. Because the layer of coating material 12 is so thin and dry, the pressuring piston 32 against roller 28 is not a problem, and will not deform or spread the coating layer, as it would with a conventional thick and wet layer. Rather than applying a single thin layer, the process is continued for several turns, continually applying more thin layers, serially. Thin layers are applied until a sufficiently thick final layer is achieved, whatever the desired thickness may be. Afterwards, is the piston 32 is transferred to a conventional curing oven, but the curing process is made much easier by the fact that no turning or manipulation of piston 32 is necessary in order to prevent the coating layer from running or sagging.

Figure 2:
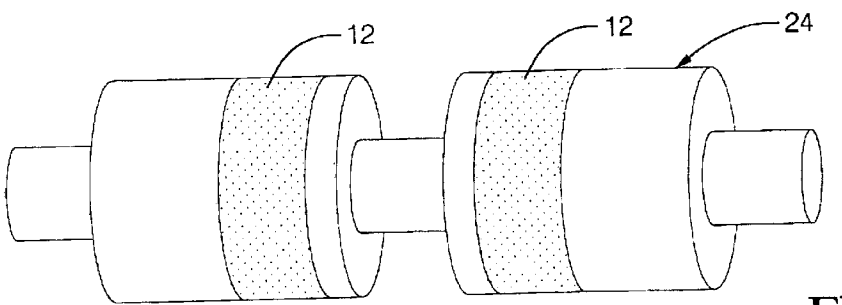
FIG. 2 is a perspective view of a pair of engraved metal application rollers.

Turning to FIGS. 1 and 2, further details of the general apparatus components and method steps outline above given. As seen in FIG. 2, cliché 24 is a steel cylindrical roller, approximately 96 mm in diameter, with a pattern etched into its surface to a depth of 20–30 microns. The etched pattern matches the pattern of coating material that it is desired to apply to piston 32, as if it were peeled off of the piston 32 and applied to the larger diameter cliché 24. In this case, the pattern is a simple cylinder as well, with a width of 37 mm, since that is the coating pattern desired on piston 32, although it could be a more complex pattern. The etched depth of the pattern, in conjunction with the squeegee 26 riding on the non etched surfaces of cliché 24, controls and determines the depth of the material that will ultimately be transferred to coating roller 28.

Figure 3:
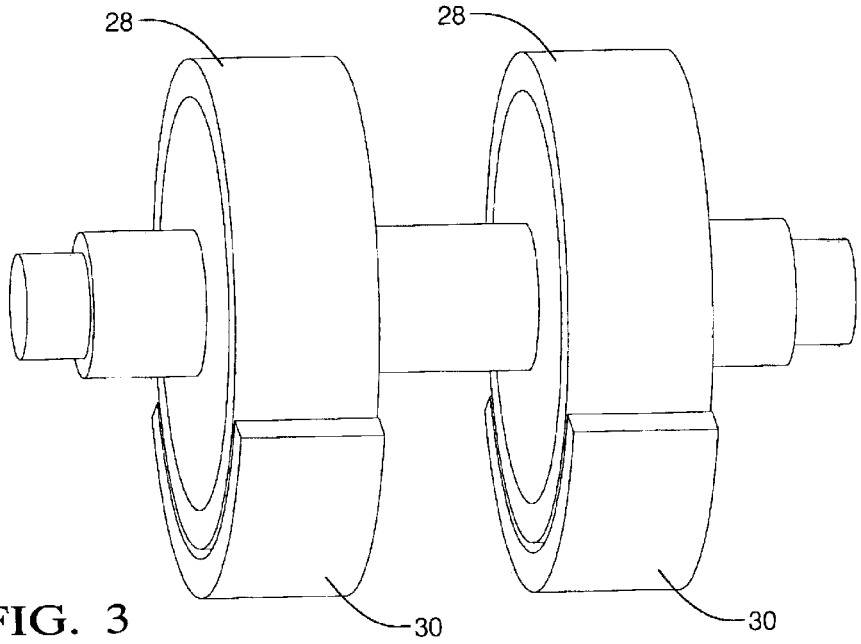
FIG. 3 is a perspective view of a pair of coating rollers and the attendant heating manifolds.

Referring next to FIGS. 1 and 3 , coating roller 28 has a cylindrical steel center "wheel" coated with resilient, silicone rubber, sleeve sixteen mm thick, 50 mm wide, and 383 mm in diameter, with a durometer of 50 on the Shore A scale. Like cliché 24, roller 28 is dualed, but each half operates identically. Coating roller 28 turns at a speed synchronized with both cliché 24 and piston 32, at speeds determined to prevent rubbing or scuffing between the engaging surfaces thereof. Roller 28 engages cliché 24 with just sufficient pressure to continually pick up the coating material 12 therefrom, at essentially the same thickness, and at substantially the same rate at which the material is applied to cliché 24. Concurrently, roller 28 is continually heated, as it turns, by the shape conforming manifold 30, which blows heated forced air against its surface. The roller 28 is heated to approximately 185–250 degrees F, which is sufficient to dry or "flash out" the majority of the organic solvent, while still leaving the coating layer wet enough to be ultimately picked up by piston 32.

Figure 4:
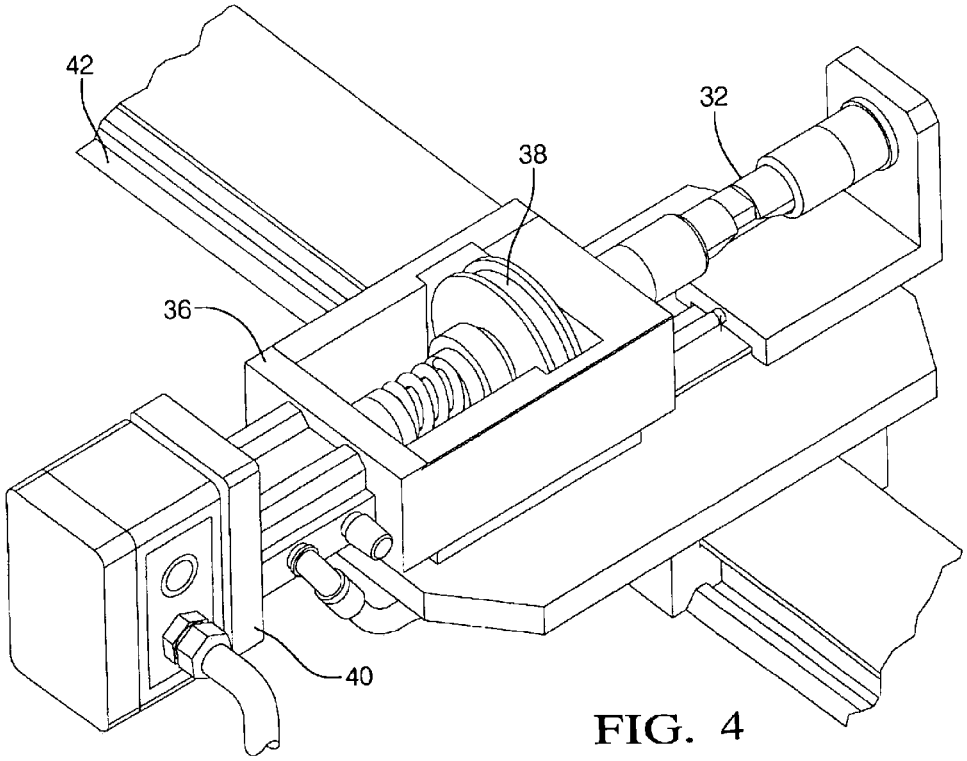
FIG. 4 is a perspective view of the support cradle of a pair of piston work pieces and the apparatus that moves them.
Figure 5:
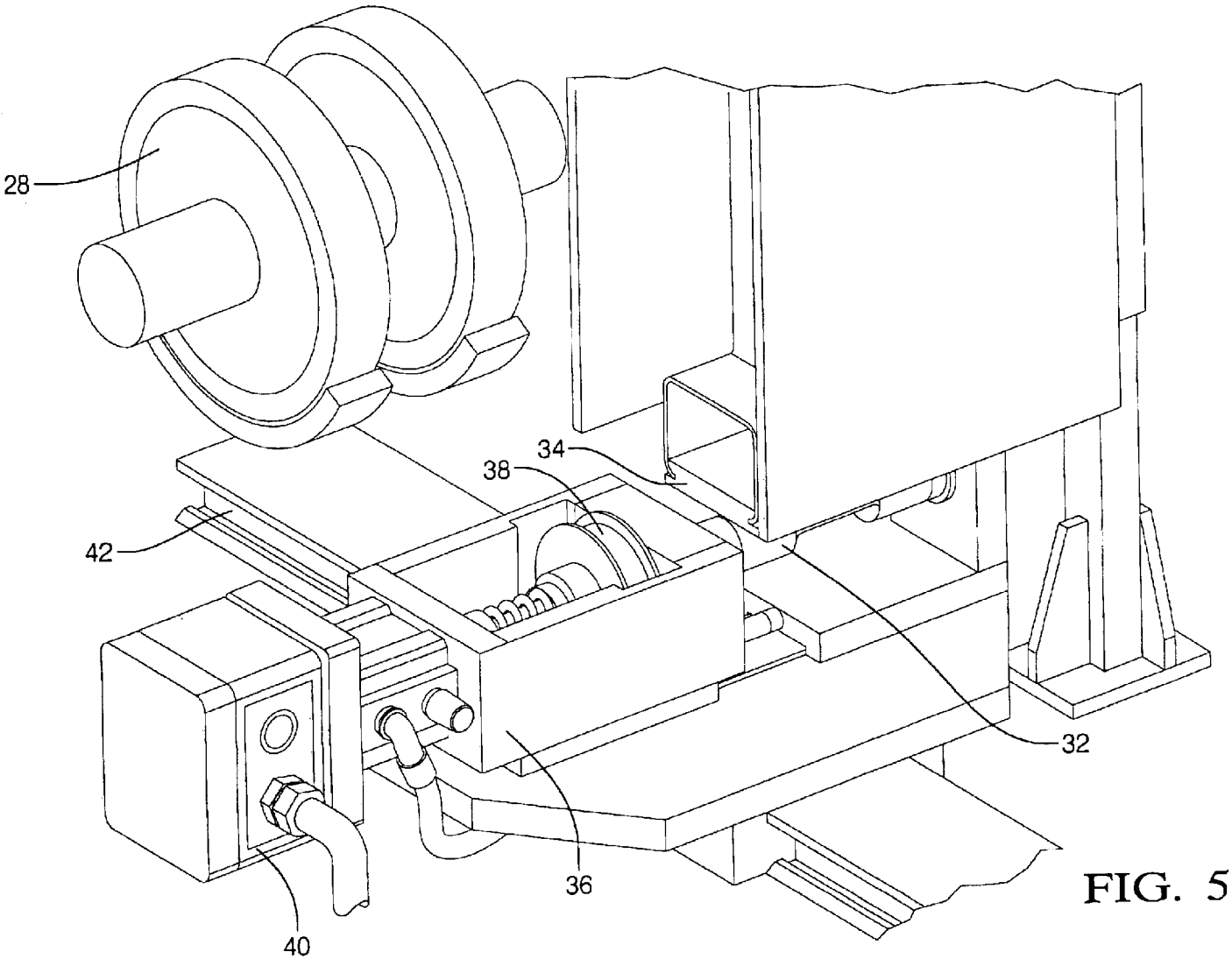
FIG. 5 is a perspective view of the apparatus showing a piston pair being pre heated prior to coating.

Referring next to FIGS. 4 and 5, before it is brought into contact With coating roller 28, piston workpiece 32 (a twinned pair, to match cliché 24 and roller 28) is loaded into a lathe-like cradle 36, in which it is supported for rotation by belt 38, and for translation linearly forward by a ball screw mechanism 40 along track 42. Piston 32 is pre heated to a comparable temperature to roller 28, or approximately 200 degrees F. This is done by rotating piston 32 below a forced hot air heater 34 for a sufficient time to heat it to the temperature noted.

Figure 7:
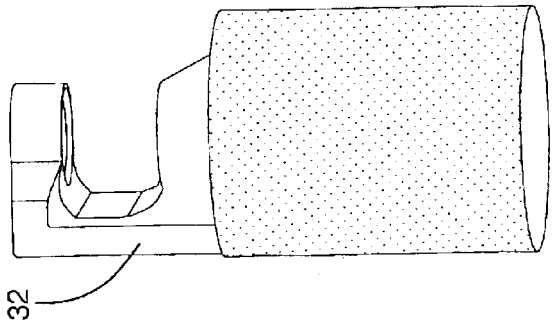
FIG. 7 is a perspective view of a finished piston.
Figure 6:
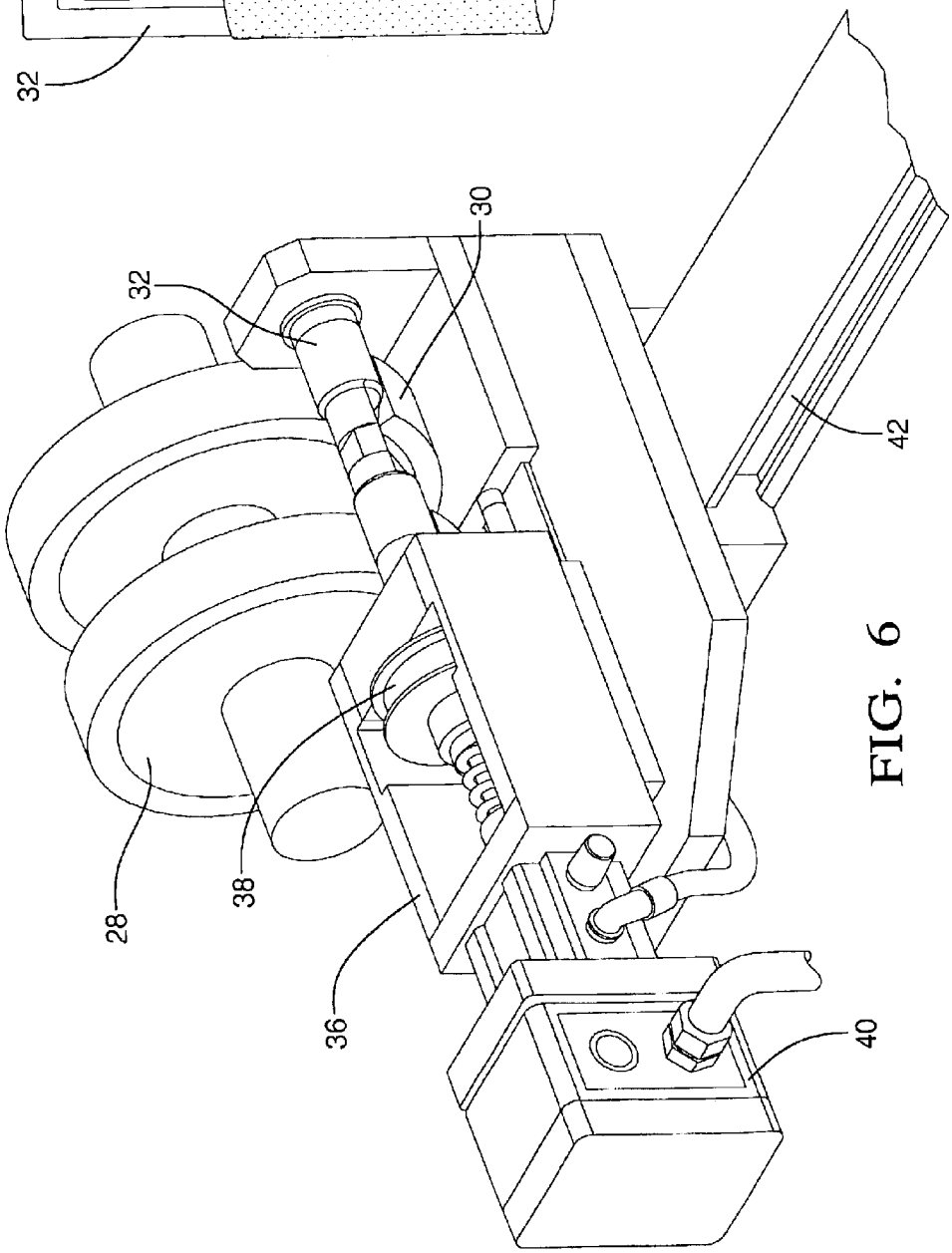
FIG. 6 is a view similar to FIG. 5, but showing the piston pair advanced under pressure into the coating roller pair.

Referring next to FIGS. 6 and 7, after pre heating, piston 32 is advanced forward into contact with coating roller 28 sufficiently to deflect the surface of coating roller approximately 20 to 30 thousandths of an inch, creating a contact pressure against piston 32 of approximately twenty to thirty two pounds per square inch. Piston 32, therefore, is not just contacting roller 28, but is compressed against it with a pressure higher than the minimum that would be necessary just to enable transfer of coating material to piston 32. Piston 32 is turned at approximately one revolution per second for approximately 15 seconds. As noted, roller 28 and cliché 24 are turned at speeds that synchronize with the rotational speed of piston 32, so as to prevent scuffing between the mutually engaging surfaces thereof. The relatively high contact pressure between coating roller 28 and piston 32, created by the compression deflection of elastomer coating roller 28, is enabled by both the thinness of the layer of coating material 12 on roller 28, and the fact that it has been pre dried to a large extent. The relatively high contact pressure helps with adhesion to the surface of piston 32, especially for the first thin coat on the first revolution, eliminating the need for pre grit blasting the surface. The same pressure helps with the mutual adhesion of subsequent thin coats, and keeps bubbles from forming. By contrast, a single layer, thicker, wetter coating material could only be applied by a lighter pressure, and would otherwise plowed up ahead of the coating roller, rather than evenly applied. The heated condition of piston 32 also helps to flash out even more solvent, and the comparable temperature of piston 32 aids the coating transfer process by creating compatibility between the mutually contacting surfaces, allowing the transferred coating to stick more readily to piston 32. The coating material ultimately loses as much as 90 per cent of its volatile component before and during the coating process. Though not separately illustrated, the entire apparatus may conveniently be surrounded by a transparent hood or cover and the flashed out solvent component may be vented out. The thinness and dryness of the coating layer applied to piston 32 by each rotation, about 3 to 5 microns deposited per rotation, aided by the contact pressure, causes the first thin layer to adhere strongly to just the smooth, non treated surface, and causes each subsequent layer to adhere strongly and evenly to the preceding layer. With 1 revolution per second and 15 seconds cycle time, 15 thin coats achieve a final thickness of approximately 70 microns thickness, ground down later to about 35–50 microns. While the coating layer applied by roller 28 is still wet and needs further curing at this point, it is dry and solid enough that piston 32 requires no special handling during the curing process to prevent sagging or dripping. The curing oven used is conventional and not further illustrated, as is the final grinding equipment. The conventional curing warms up to curing temperature of approximately 435 degrees F in several stages, after which the coated pistons 32 cure for about 110 minutes total. The process does not shorten curing time appreciably, but does make the process much easier since there is no potential for the coating to run or sag, and no need for any special manipulation to prevent it. The final result, as shown in FIG. 7, is a piston 32 with a solid, well adhered coating, free of runs, drips or bubbles, which has sufficient extra thickness available to be ground down to the desired final thickness. In other words, the desired final thickness resulting from the coating method disclosed will likely be somewhat greater than the final, post grinding thickness, as determined by how much final grind is desired.

The coating material 12 itself is a mixture of solid and solvent (volatile organic compounds) in a solid to solvent weight ratio of approximately 42.96% to 57.04% respectively, plus or minus a percent. Of the solvent component, it is comprised of the compounds and percentages listed in the following table:

| Solvent wt % | Solvent wt % |
|---|---|
| N-Methyl Pyrolidone | 38.25 |
| XYLOL | 8.31 |
| Methyl Isobutyl Ketone | 7.2 |
| Cyclohexanone | 3.57 |
| Butyl Cellosolve | 0.84 |
| Total | 58.17 |

The solid component, as noted above, is primarily polyamideimide resin binder, which is typical. However, the remainder of the solid component is primarily titanium dioxide, and is not primarily PTFE, which is not typical. Only 0 to 5% of the solid component, by weight percentage is PTFE, while 12 to 35% by weight is titanium dioxide. This gives a hard, ceramic like coating with a pencil hardness of 5H or higher, much harder than typical high PTFE percentage coatings, and also a coating with a coefficient of thermal expansion much closer to that of the base aluminum. The PTFE could, if desired, be eliminated almost entirely, since dry running of the piston 32 in the compressor is a rare and short event, and the lower to non existent percentage of PTFE performs much better in terms of wetting compatibility with typical lubricants that are entrained in the refrigerant. The polyamide resin itself provides a smooth and slippery coating, independent of any PTFE component present.

Variations in the disclosed apparatus and method could be made. Other coating material formulas could be used, but all will have a volatile organic solvent component capable of being flashed out during the process so as to allow for the thin, relatively dry, serial coating layers. The diameters of all of the mutually engaging rotating components could be different, so long as their rotational speeds were synchronized. For example, a much larger diameter coating roller 28 could hold more total coating material, and would simply be turned at a proportionately lower speed. The supply or reservoir of coating material (tank 10) need not absolutely be kept closed from the environment, just in order to apply it to coating roller 28. However, there would unlikely be any reason not to do so, since viscosity and quality control of the coating material are made much easier by the closed reservoir. Likewise, some means other than cliché 24 would theoretically be used to apply a thin layer to roller 28 directly, such as a very precisely controlled nozzle assembly or some other means. However, the cliché 24 is a simple and durable part and works well to control the thickness of material applied, in conjunction with squeegee 26. The roller 28 and/or piston 32 could be heated more or less highly, so as to flash out more or less solvent as desired, but, in general, it is desired to flash out most of the solvent both before and during the process of transfer from roller 28 to piston 32, so as to pre dry the coating layer sufficiently to make it immune to any gravitational effects, and so as to leave a solid, well adhered layer not liable to bubbling later during curing. The pressure between roller 28 and piston 32 need not be higher than just the minimal pressure necessary to assure coating transfer, but a higher pressure is thought to aid the adhesion process, and, as noted, is possible because the serially applied layers are so thin and relatively dry. In the coating material 12 itself, the percentages of the solid component could be varied somewhat, although it is preferable that there be a relatively low (or even no) percentage of PTFE, and a relatively high percentage of titanium dioxide or similar ceramic material that is compatible with the resin binder.

What is claimed is:

1. A method for applying a wear resistant coating of a pre determined final thickness to a cylindrical object, said coating having, in a pre application, liquid state, a solid component and a volatile solvent component, comprising the steps of, providing a supply of liquid coating material, providing a rotatable, cylindrical coating roller, continually applying a layer of liquid coating material to said coating roller, thinner than said pre determined final thickness, while concurrently heating said coating roller sufficiently to substantially remove said volatile solvent component, concurrently pre heating said cylindrical workpiece sufficiently to substantially remove the remainder of said volatile solvent component, engaging said pre heated cylindrical workpiece with said coating roller in a synchronous rotation and under sufficient pressure to transfer coating material from said coating roller to said workpiece while concurrently substantially removing the remainder of the volatile solvent component, for a sufficient number of rotations to apply a final layer with a total thickness at least equal to said pre determined final thickness.

2. A method according to claim 1, further characterized in that said pre heated workpiece is engaged with said coating roller at a pressure higher than the pressure needed just to transfer coating material.

3. A method according to claim 1, further characterized in that said supply of liquid coating material is retained in a closed reservoir.

4. A method according to claim 1, further characterized in that said liquid coating material is applied to said coating roller by distribution roller rotated synchronously with said coating roller.

5. A method according to claim 4, further characterized in that said distribution roller is a metal roller etched to a depth less than said pre determined final thickness.

* * * * *